US008510914B2

(12) United States Patent
Minegishi

(10) Patent No.: US 8,510,914 B2
(45) Date of Patent: Aug. 20, 2013

(54) CHECKER-EQUIPPED DOOR HINGE DEVICE FOR USE IN VEHICLE

(75) Inventor: Yumiko Minegishi, Sakado (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 0 days.

(21) Appl. No.: 13/511,032

(22) PCT Filed: Oct. 27, 2010

(86) PCT No.: PCT/JP2010/069081

§ 371 (c)(1), (2), (4) Date: May 21, 2012

(87) PCT Pub. No.: WO2011/065178

PCT Pub. Date: Jun. 3, 2011

(65) Prior Publication Data

US 2012/0233814 A1 Sep. 20, 2012

(30) Foreign Application Priority Data

Nov. 24, 2009 (JP) ..... 2009-266519

(51) Int. Cl.
*E05D 11/10* (2006.01)

(52) U.S. Cl.
USPC ..... 16/334; 16/342

(58) Field of Classification Search
USPC ..... 16/285, 287, 288, 366, 370, 334, 16/328, 331, 332, 284; 296/146.11, 146.12
See application file for complete search history.

(56) References Cited

U.S. PATENT DOCUMENTS

| | | | | |
|---|---|---|---|---|
| 5,412,842 | A * | 5/1995 | Riblett | 16/334 |
| 5,918,347 | A | 7/1999 | Morawetz | |
| 6,012,201 | A * | 1/2000 | Mitts et al. | 16/334 |
| 6,073,308 | A * | 6/2000 | Linnenbrink et al. | 16/334 |
| 6,481,056 | B1 * | 11/2002 | Jesse | 16/334 |
| 6,581,243 | B2 * | 6/2003 | Parizel | 16/334 |
| 6,739,020 | B1 * | 5/2004 | Morawetz | 16/334 |
| 7,203,996 | B2 * | 4/2007 | Linnenbrink et al. | 16/334 |
| 7,373,693 | B2 * | 5/2008 | Markl et al. | 16/374 |
| 7,461,432 | B2 * | 12/2008 | Lowen | 16/334 |
| 2003/0093873 | A1 * | 5/2003 | Linnenbrink | 16/85 |
| 2009/0133222 | A1 * | 5/2009 | Ochiai | 16/347 |
| 2010/0018004 | A1 | 1/2010 | Ochiai et al. | |
| 2010/0139044 | A1 * | 6/2010 | Minegishi | 16/333 |

* cited by examiner

FOREIGN PATENT DOCUMENTS

| | | | |
|---|---|---|---|
| DE | 102 54 032 | A1 | 6/2004 |
| JP | 1-260187 | A | 10/1989 |
| JP | 10-061305 | A | 3/1998 |
| JP | 2008-157012 | A | 7/2008 |

*Primary Examiner* — Chuck Y. Mah

(74) *Attorney, Agent, or Firm* — Carrier Blackman & Associates, P.C.; Joseph P. Carrier; William D. Blackman

(57) ABSTRACT

A checker-equipped door hinge device for use in a vehicle includes a check force generating mechanism having a central shaft fixed to a female bracket, a cylinder block fixed to a male bracket and having a cylinder portion, a piston slidably fitted into the cylinder portion, a detent roller supported by the piston, a check spring for urging the piston, and a detent groove provided on an outer peripheral face of the central shaft and with which the detent roller is engaged by urging force of the check spring. The male bracket includes male arm portions for sandwiching the cylinder block inside female arm portions, and a male base portion connected to the male arm portions. The male arm portion is fixedly secured to the cylinder block, and opposite end parts of the central shaft extending through the male arm portion are fixedly secured to the female arm portion.

10 Claims, 9 Drawing Sheets

DOOR FULLY CLOSED STATE

DOOR FULLY OPENED STATE

CHECKER-EQUIPPED DOOR HINGE DEVICE FOR USE IN VEHICLE

TECHNICAL FIELD

The present invention relates to a door hinge device for use in a vehicle, the device supporting a door for opening and closing a tailgate or an entry opening of an automobile, etc. and, in particular, relates to an improvement of a checker-equipped door hinge device for use in a vehicle, the device including a female bracket that is formed from a female base portion fixedly secured to one of a body and a door and a pair of female arm portions rising from opposite side ends of the female base portion, a male bracket that is disposed between the pair of female arm portions while having a male base portion fixedly secured to the other of the body and the door and is relatively pivotably linked to the female arm portions via a hinge pin, and a check force generating mechanism that is arranged between the female and male brackets and generates a check force for the door at a predetermined degree of opening position of the door, this check force generating mechanism including a central shaft that is fixed to the female bracket and disposed around the hinge pin, a cylinder block that is fixed to the male bracket and disposed so as to relatively rotatably surround the central shaft and has a cylinder portion projecting toward one side of the central shaft, a piston that is slideably fitted into an inner peripheral face of the cylinder portion, a detent roller that is supported by the piston and can roll on an outer peripheral face of the central shaft, a check spring that urges the piston toward the outer peripheral face of the central shaft, and a detent groove that is provided on the outer peripheral face of the central shaft and with which the detent roller is resiliently engaged by means of the urging force of the check spring at the predetermined degree of opening position of the door.

BACKGROUND ART

Such a checker-equipped door hinge device for use in a vehicle is already known, as disclosed in Patent Document 1 below.

RELATED ART DOCUMENT

Patent Document

Patent Document 1: German Patent Publication DE10254032A1

SUMMARY OF THE INVENTION

Problems to be Solved by the Invention

In such a conventional checker-equipped door hinge device for use in a vehicle, since a male bracket and a cylinder block are formed as a unit by providing a male base portion of the male bracket integrally with an extremity part of a cylinder portion of the cylinder block, the dimensions of a male arm portion of the male base portion are increased, and it is therefore difficult to make the checker-equipped door hinge device for use in a vehicle compact.

The present invention has been accomplished in light of such circumstances, and it is an object thereof to provide a compact checker-equipped door hinge device for use in a vehicle by enabling a male bracket to be arranged without interfering with the disposition of a cylinder block.

Means for Solving the Problems

In order to attain the above object, according to a first aspect of the present invention, there is provided a checker-equipped door hinge device for use in a vehicle, the device comprising a female bracket that is formed from a female base portion fixedly secured to one of a body and a door and a pair of female arm portions rising from opposite side ends of the female base portion, a male bracket that is disposed between the pair of female arm portions while having a male base portion fixedly secured to the other of the body and the door and is relatively pivotably linked to the female arm portions via a hinge pin, and a check force generating mechanism that is arranged between the female and male brackets and generates a check force for the door at a predetermined degree of opening position of the door, this check force generating mechanism comprising a central shaft that is fixed to the female bracket and disposed around the hinge pin, a cylinder block that is fixed to the male bracket and disposed so as to relatively rotatably surround the central shaft and has a cylinder portion projecting toward one side of the central shaft, a piston that is slideably fitted into an inner peripheral face of the cylinder portion, a detent roller that is supported by the piston and can roll on an outer peripheral face of the central shaft, a check spring that urges the piston toward the outer peripheral face of the central shaft, and a detent groove that is provided on the outer peripheral face of the central shaft and with which the detent roller is resiliently engaged by means of an urging force of the check spring at the predetermined degree of opening position of the door, characterized in that the male bracket comprises a pair of male arm portions that are adjacent to respective inside faces of the pair of female arm portions and are disposed so as to sandwich the cylinder block along an axial direction of the central shaft, and the male base portion, which is provided so as to be connected to one end of these male arm portions, the male arm portion is fixedly secured to the cylinder block, a bearing hole supporting the central shaft is provided in the pair of male arm portions, and opposite end parts of the central shaft extending through these bearing holes are fixedly secured to the female arm portion.

Further, according to a second aspect of the present invention, in addition to the first aspect, the cylinder block comprises a bearing portion that has a U-shaped cross section and relatively rotatably supports a semi-circumferential face of the central shaft, and the cylinder portion, which is linked integrally to opposite end parts of the bearing portion, an opening is provided at opposite ends, along the axial direction of the central shaft, of the cylinder block, the opening enabling the central shaft, the piston, the check spring, and the detent roller to be housed in the cylinder block, and the opening is closed by the male arm portion.

Furthermore, according to a third aspect of the present invention, in addition to the first or second aspect, a length in an axial direction of the cylinder portion is set smaller than an inside measurement or internal diameter thereof, and a plurality of disc springs superimposed on one another as the check spring are housed within the cylinder portion.

Moreover, according to a fourth aspect of the present invention, in addition to the third aspect, an outside measurement or external diameter of the piston and an external diameter of the disc spring are set larger than an external diameter of the central shaft.

Further, according to a fifth aspect of the present invention, in addition to any one of the first to fourth aspects, the cylinder portion and the piston are formed so as to have a rectangular cross section.

Furthermore, according to a sixth aspect of the present invention, in addition to the first aspect, a positioning projection and a positioning groove that engage with each other are formed on opposing faces of the central shaft and the female arm portion, the positioning projection being provided so as to extend on an end face of the central shaft along a diameter thereof, the positioning groove being provided on an inside face of the female arm portion so that one end of the positioning groove opens on an outer peripheral face of the female arm portion, and a state in which the positioning projection and the positioning groove are engaged being retained by the hinge pin extending through the female arm portion and the central shaft.

Effects of the Invention

In accordance with the first aspect of the present invention, since the male bracket is formed from the pair of male arm portions that are adjacent to the respective inside faces of the pair of female arm portions and are disposed so as to sandwich the cylinder block along the axial direction of the central shaft and the male base portion provided so as to be connected to one end of these male arm portions, and the male arm portion is fixedly secured to the cylinder block, the check force generating mechanism equipped with the male bracket can be assembled as a unit independently of the female bracket, and it is possible to easily and efficiently carry out an assembly operation of the check force generating mechanism equipped with the male bracket. Moreover, since the pair of male arm portions of the male bracket are adjacent to the respective inside faces of the pair of female arm portions and are disposed so as to sandwich the cylinder block along the axial direction of the central shaft, it is possible to prevent the male bracket from becoming very long and contribute to making the checker-equipped door hinge device for use in a vehicle compact.

In accordance with the second aspect of the present invention, since the central shaft, the piston, the check spring, and the detent roller are housed in the cylinder block from the opening thereof, and the opening is closed by the male arm portion of the male bracket, it is possible for the male arm portion to prevent the detent roller from falling out and it is also possible to prevent rainwater or dirt from entering the cylinder block. Furthermore, the male bracket functions also as a lid body closing the opening, and the structure can be simplified. Moreover, since the pair of male arm portions linked to the male base portion are linked integrally via the cylinder block, it becomes unnecessary to employ a large-size male base portion that directly integrally links the two male arm portions, and it is possible to make the male bracket lightweight and compact.

In accordance with the third aspect of the present invention, due to the mutual effect of setting the length in the axial direction of the cylinder portion smaller than the inside measurement or the internal diameter and housing the plurality of disc springs superimposed on one another as the check spring within the cylinder portion, it is possible to apply a sufficient check force to the door while minimizing the amount of the cylinder portion projecting toward the central shaft, and make the check force generating mechanism compact effectively.

In accordance with the fourth aspect of the present invention, setting the outside measurement or the external diameter of the piston and the external diameter of the disc spring, which are housed in the cylinder portion, larger than the external diameter of the central shaft enables excessive increase in the spring constant to be suppressed while applying a sufficient set load to the plurality of disc springs, which are check springs, thus improving the durability thereof.

In accordance with the fifth aspect of the present invention, forming the piston and the cylinder portion so as to have a rectangular cross section enables the cylinder portion to prevent the piston from rotating, enables mutual engagement between the detent roller and the detent groove always to be carried out appropriately, and makes it unnecessary to employ a special detent member for the piston, thus contributing to simplification of the structure.

In accordance with the sixth aspect of the present invention, the positioning projection of the central shaft can easily engage with the positioning groove from the open end, this engaged state is retained by utilizing the hinge pin extending through the female arm portion and the central shaft, the retaining structure is simple, and the female arm portion and the central shaft can be linked to each other strongly.

EXPLANATION OF REFERENCE NUMERALS AND SYMBOLS

Figure 1:
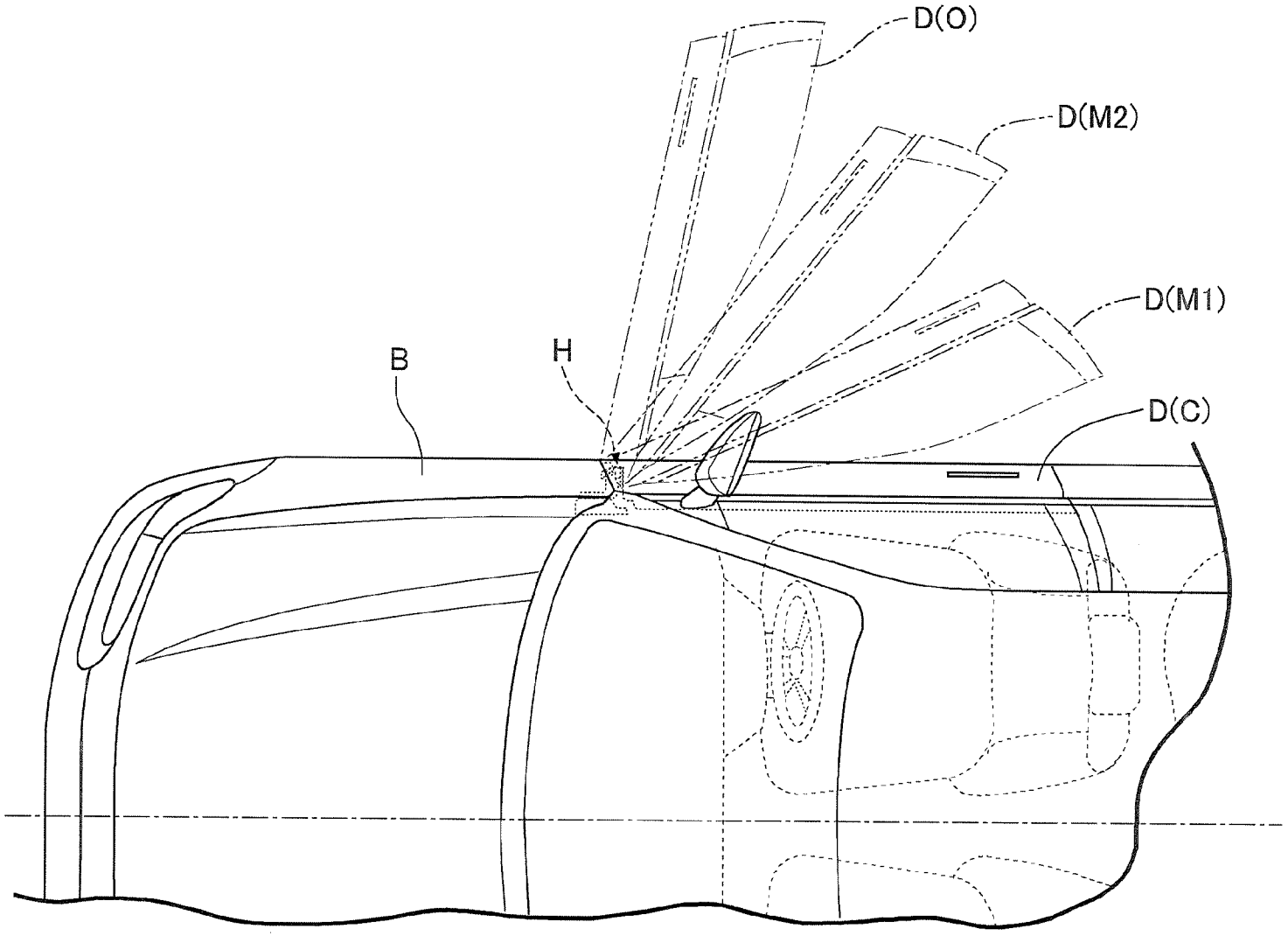
FIG. 1 is a plan view of an essential part of an automobile that is provided with a checker-equipped door hinge device related to a first embodiment of the present invention. (first embodiment)

B Body
D Door
H Checker-equipped door hinge device
1 Female bracket
1*a* Female base portion
1*b* Female arm portion
2 Male bracket
2*a* Male base portion
2*b* Male arm portion
5 Hinge pin
6 Central shaft
7 Cylinder block
7*a* Bearing portion
7*b* Cylinder portion
10 Opening
11 Bearing hole
20 Check force generating mechanism
22 Piston
23 Check spring
23*a* Disc spring

26 Detent roller

27*c* Fully closed detent groove

27*m*1 Intermediate detent groove (first intermediate detent groove)

27*m*2 Intermediate detent groove (second intermediate detent groove)

27*o* Fully open detent groove

MODES FOR CARRYING OUT THE INVENTION

Modes for carrying out the present invention are explained below by reference to preferred embodiments of the present invention shown in the attached drawings.

Embodiment 1

A first embodiment of the present invention shown in FIG. 1 to FIG. 8 is now explained. In FIG. 1, a door D of an automobile for opening and closing an entry opening thereof is pivotably mounted on a body B via a checker-equipped door hinge device H, the checker-equipped door hinge device H being capable of retaining the door D at a predetermined fully closed position C, first intermediate degree of opening position M1, second intermediate degree of opening position M2, and fully open position O.

As shown in FIG. 2 to FIG. 5, the checker-equipped door hinge device H includes a female bracket 1 fixedly secured to the body B via a plurality of bolts 3, a male bracket 2 fixedly secured to the door D via a plurality of bolts 4, and a hinge pin 5 disposed in the vertical direction so as to relatively pivotably link these two brackets 1 and 2.

The female bracket 1 is formed from a female base portion 1*a* fixedly secured to a vertical wall of the body B via a plurality of bolts 3 and a pair of upper and lower female arm portions 1*b* and 1*b* connected integrally to opposite upper and lower ends of the female base portion 1*a*, the male bracket 2 is formed from a pair of upper and lower male arm portions 2*b* and 2*b* that are disposed so as to be adjacent to the inside of the pair of female arm portions 1*b* and 1*b* and male base portions 2*a* and 2*a* that are bent at a right angle from one end of the respective male arm portions 2*b* and 2*b* and fixedly secured to the door D via a plurality of bolts 4, and the hinge pin 5 is disposed so as to extend vertically through the female arm portions 1*b* and 1*b* and the male arm portions 2*b* and 2*b*. The hinge pin 5 is fixedly secured to the female arm portions 1*b* and 1*b* by an expanded head portion 5*a* at one end and a swaged portion 5*b* at the other end.

A central shaft 6 is relatively rotatably fitted around the outer periphery of the hinge pin 5. This central shaft 6 is formed from a barrel portion 6*a* disposed so as to be sandwiched between the two male arm portions 2*b* and 2*b*, and a pair of small-diameter short shafts 6*b* and 6*b* projectingly provided integrally with opposite end faces of the barrel portion 6*a*, these short shafts 6*b* and 6*b* extending through bearing holes 11 and 11 provided in the male arm portions 2*a* and 2*a* and projecting outward, and bearing bushes 16 and 16 rotatably supporting the short shafts 6*b* and 6*b* are fitted into the bearing holes 11 and 11.

Opposing faces of the two short shafts 6*b* and 6*b* and the two female arm portions 1*b* and 1*b* are provided with a positioning projection 8 and a positioning groove 9 that engage with each other. The positioning projection 8 extends on an end face of the central shaft 6 along a diameter line, the positioning groove 9 is formed on the inside face of the female arm portion 1*b* so that it traverses a pin hole 18 through which the hinge pin 5 extends, and one end of the positioning groove 9 opens on the outer peripheral face of the female arm portion 1*b*. The positioning projection 8 of the central shaft 6 can therefore easily engage with the positioning groove 9 from its open end, and the engaged state thereof is retained by inserting the hinge pin 5 into the female arm portions 1*b* and 1*b* and the central shaft 6. Therefore, the engaged state of the positioning projection 8 and the positioning groove 9 is retained by utilizing the hinge pin 5, the retaining structure is simple, and it is possible to link the female arm portions 1*b* and 1*b* and the central shaft 6 to each other strongly.

Figure 2:
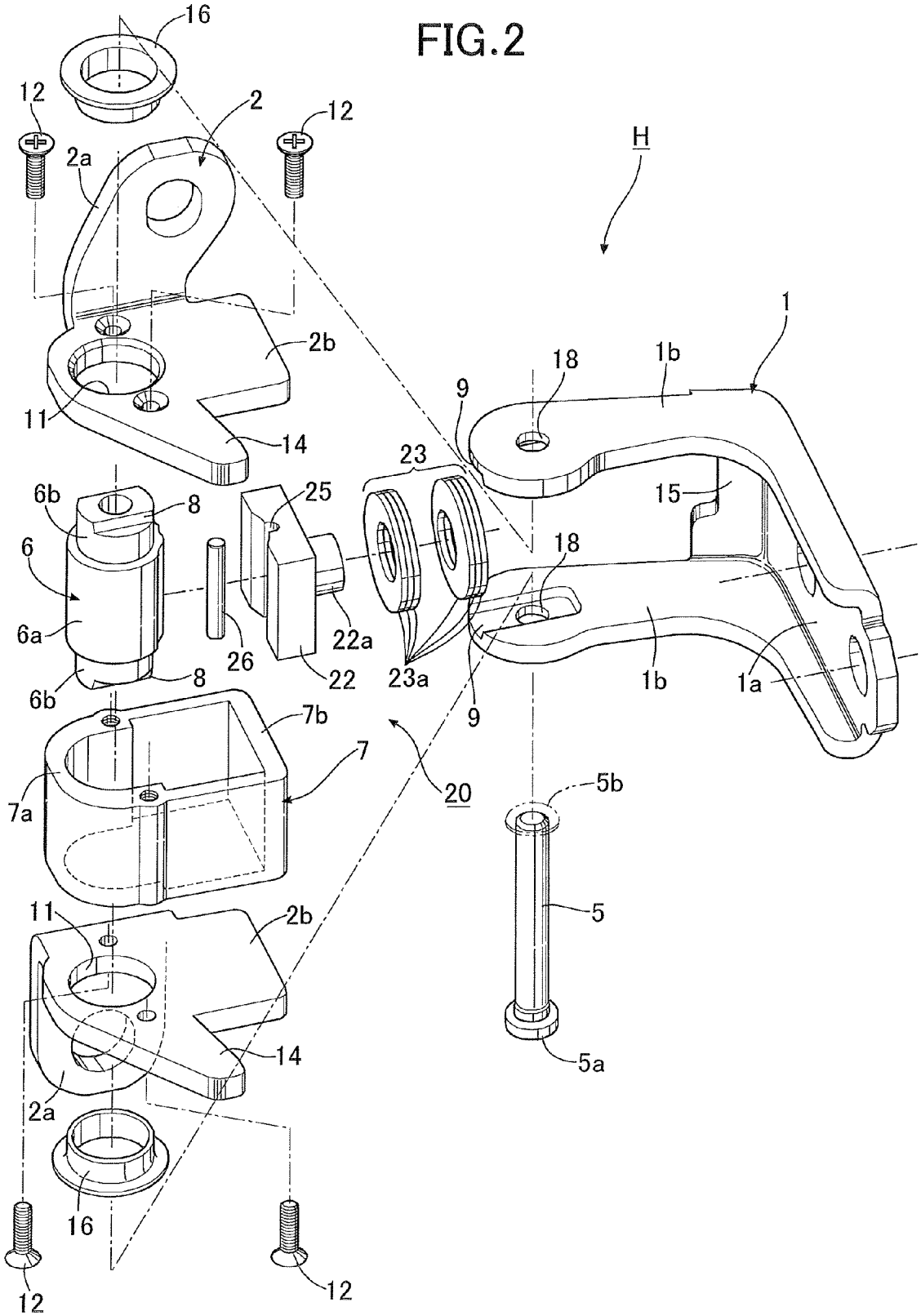
FIG. 2 is an exploded perspective view of the checker-equipped door hinge device. (first embodiment)
Figure 3:
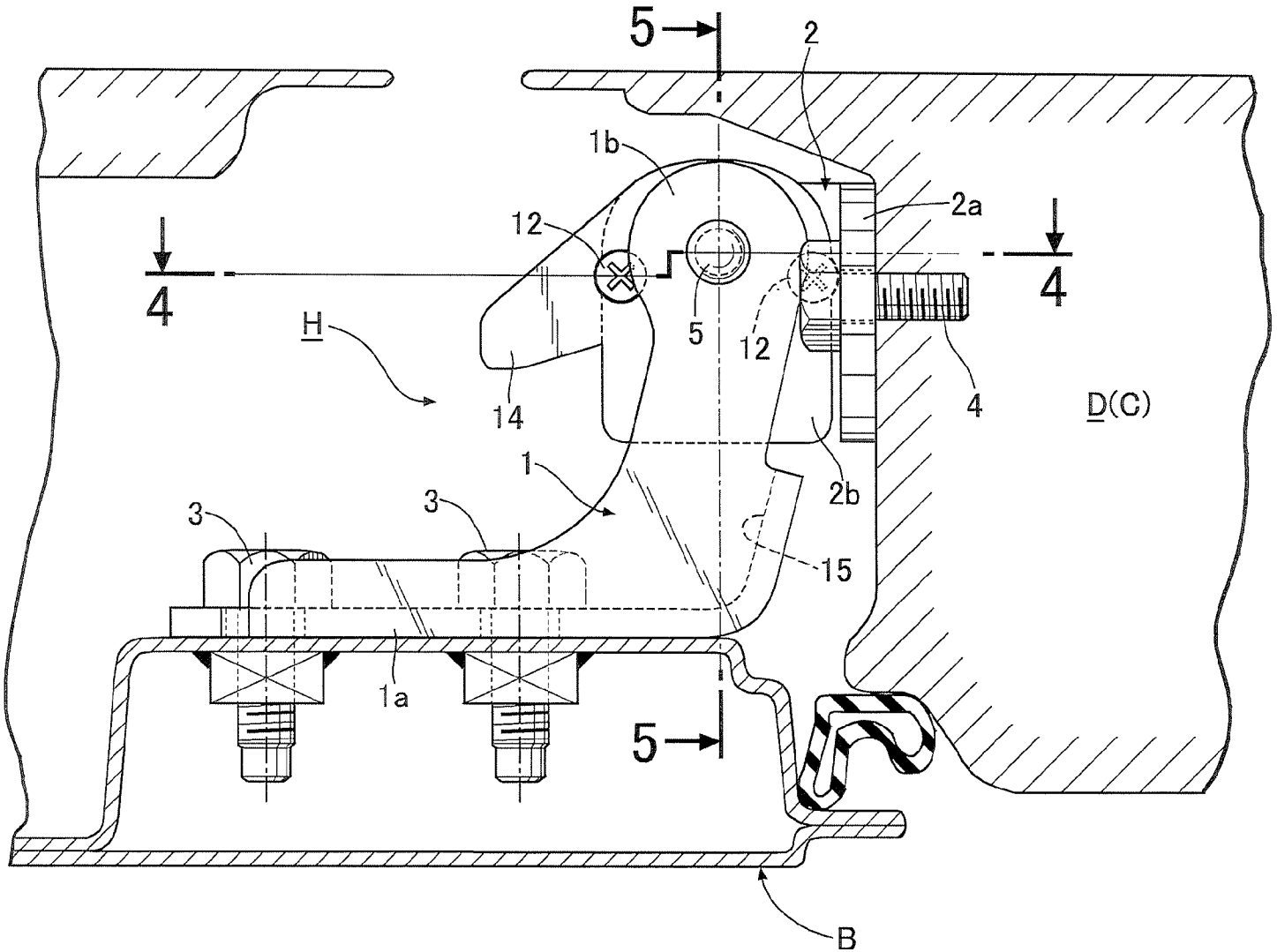
FIG. 3 is a plan view showing the checker-equipped door hinge device in a state in which a door is closed. (first embodiment)
Figure 4:
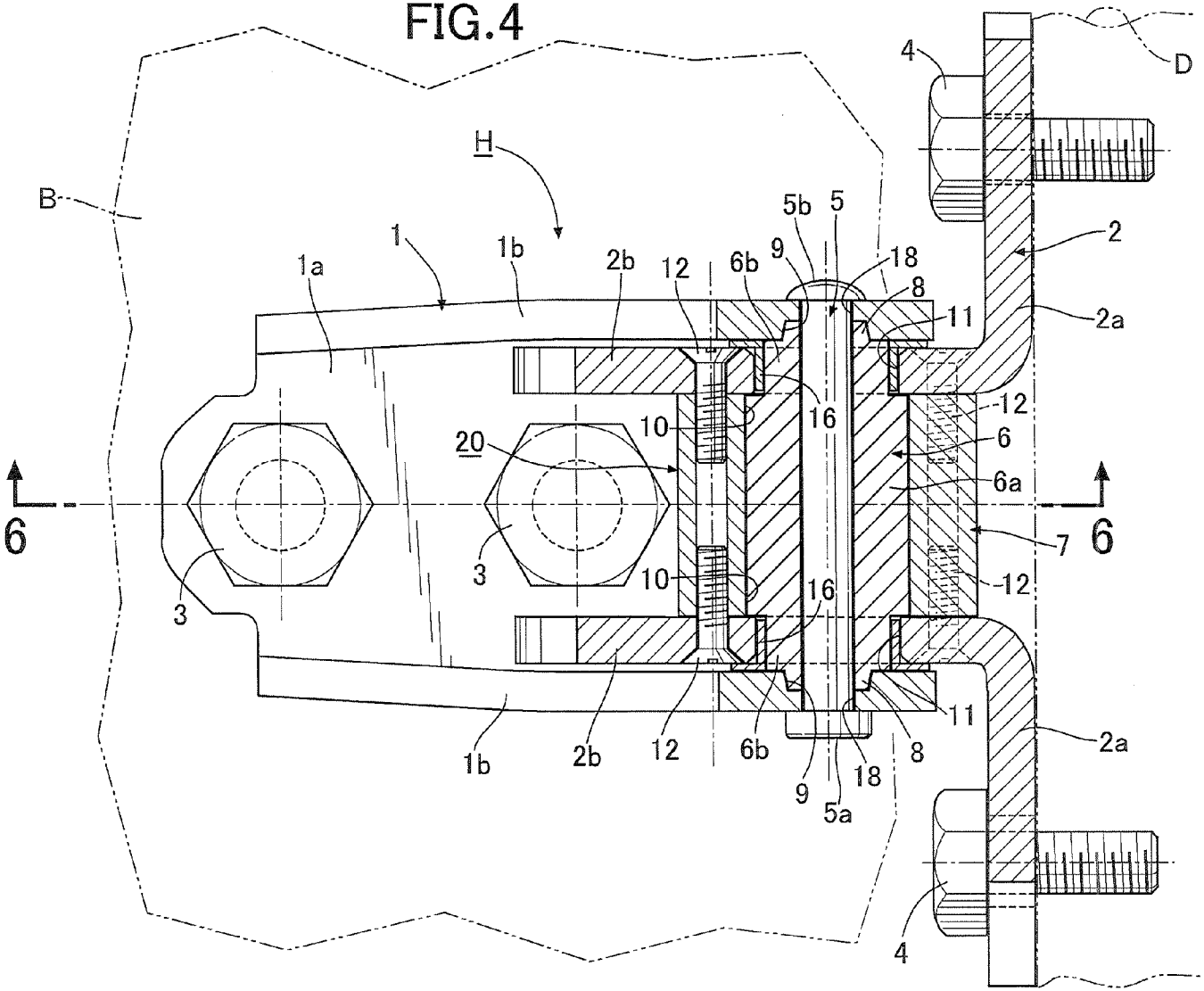
FIG. 4 is a sectional view along line 4-4 in FIG. 3. (first embodiment)
Figure 5:
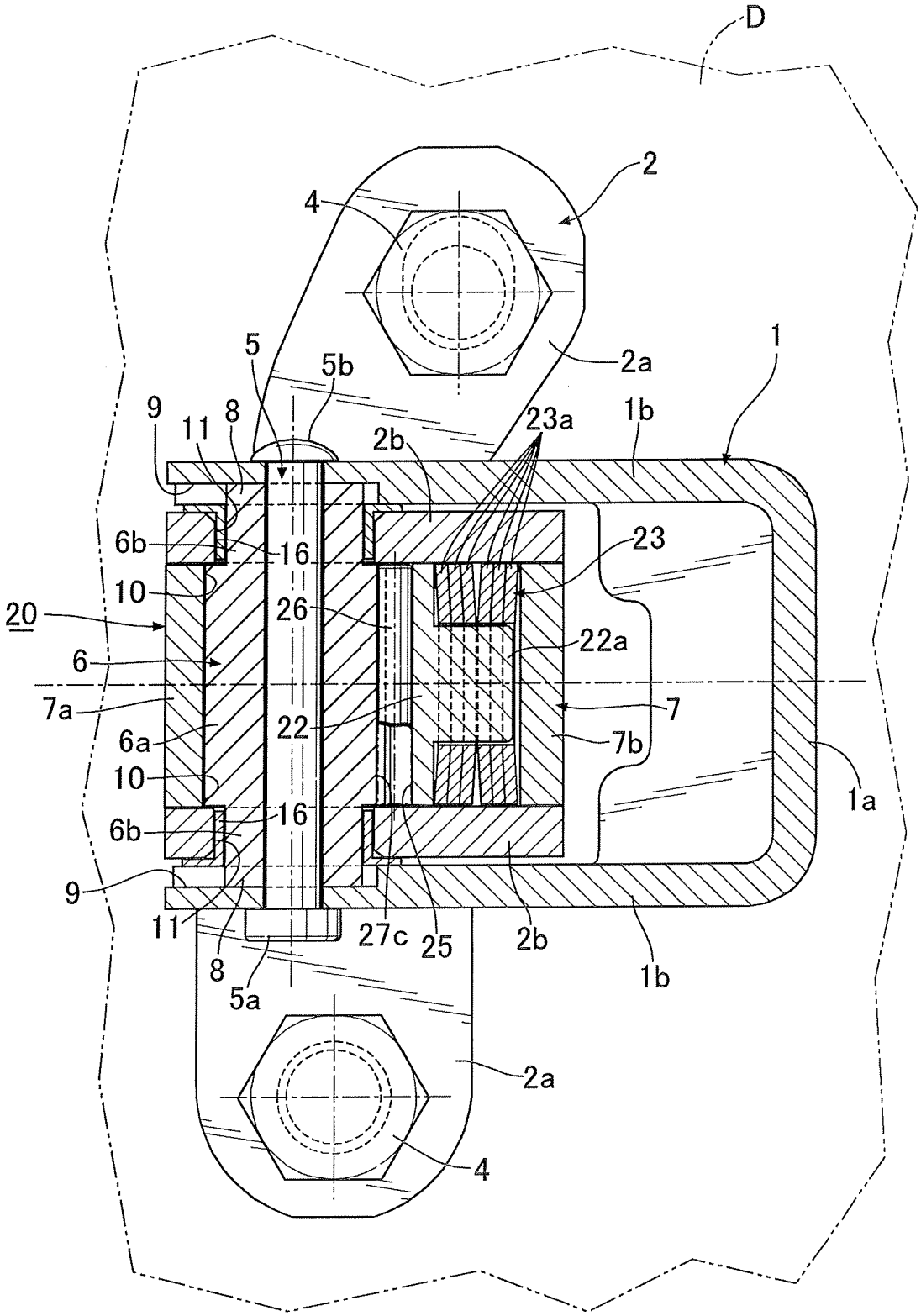
FIG. 5 is a sectional view along line 5-5 in FIG. 3. (first embodiment)
Figure 6:
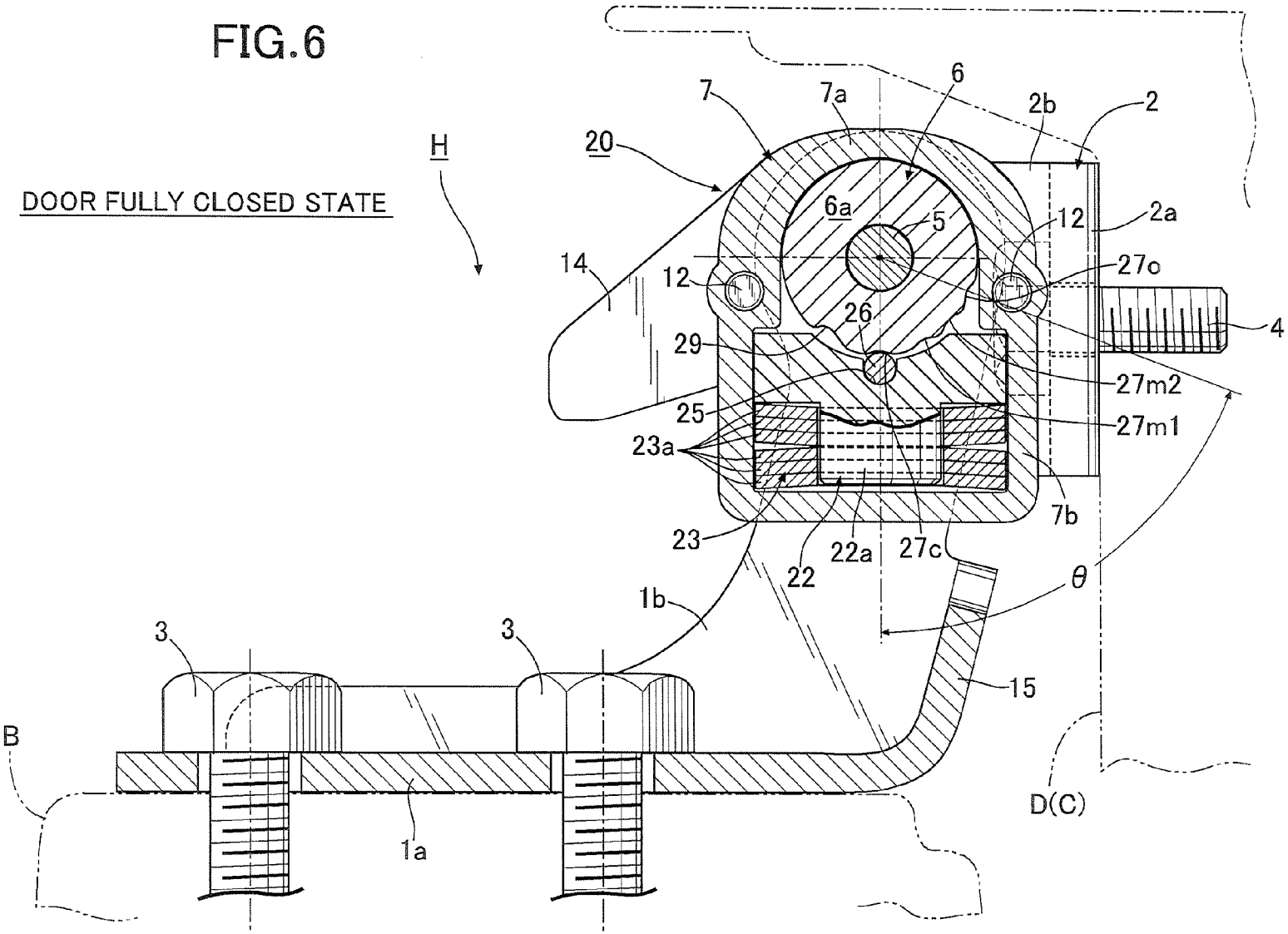
FIG. 6 is a sectional view along line 6-6 in FIG. 4. (first embodiment)

As shown in FIG. 2, FIG. 4, and FIG. 5, the bearing bushes 16 and 16 rotatably supporting the central shaft 6 are fitted into the bearing holes 11 and 11 of the pair of male arm portions 2*a* and 2*a*. Furthermore, a cylinder block 7 is disposed relatively rotatably on the outer periphery of the central shaft 6, and the pair of male arm portions 2*b* and 2*b* of the male bracket 2 are fixedly secured to opposite end faces, along the axial direction of the central shaft 6, of the cylinder block 7 by means of screws 12 and 12.

The cylinder block 7 is formed from a bearing portion 7*a* having a U-shaped cross section and relatively rotatably supporting the outer peripheral face of the central shaft 6 over half its circumference, and a cylinder portion 7*b* linked integrally to opposite end parts of the bearing portion 7*a*, the cylinder portion 7*b* housing in its interior a piston 22 having an arc face opposing the outer peripheral face of the central shaft 6 and a check spring 23 urging the piston 22 toward the central shaft 6 with a predetermined set load.

A length L in the axial direction of the cylinder portion 7*b* is set smaller than an inside measurement D1 or internal diameter of the cylinder portion 7*b*, and with respect thereto the check spring 23 is formed by superimposing a plurality of disc springs 23*a* within the cylinder portion 7*b*. In the illustrated example, two sets of a plurality of disc springs 23*a* superimposed in the same direction are disposed so that back sides thereof face each other. By so doing, it is possible to impart a sufficient set load and deformation stroke to the check spring 23. Furthermore, an outside measurement D2 or external diameter of the piston 22 and an external diameter D3 of the disc springs 23*a* are set larger than an external diameter D4 of the central shaft 6. The cylinder portion 7*b* and the piston 22 are formed so as to have a rectangular cross section, and are formed as a square cross section in the illustrated example. The piston 22 is provided with a guide shaft 22*a* that extends through center holes of the disc springs 23*a* so as to align them.

A semi-cylindrical retaining groove 25 opening toward the central shaft 6 and extending in the axial direction of the central shaft 6 is formed on an arc face, opposing the outer peripheral face of the central shaft 6, of the piston 22, and a substantially semi-circumferential portion of a detent roller 26 that can roll on the outer peripheral face of the central shaft 6 is rotatably engaged with and retained by the retaining groove 25.

Provided on the outer peripheral face of the barrel portion 6*a* of the central shaft 6 facing the interior of the cylinder block 7 are a fully closed detent groove 27*c*, a first intermediate detent groove 27*m*1, a second intermediate detent groove 27*m*2, and a fully open detent groove 27*o*, with which the detent roller 26 is resiliently engaged by means of the set load of the check spring 23 when the door D comes to a predetermined fully closed position C, first intermediate degree of opening position M1, second intermediate degree of opening position M2, and fully open position O (ref FIG. 1), these detent grooves 27*c* to 27*o* having a minor arc-shaped or V-shaped cross section. The detent roller 26 increases the compressive load of the check spring 23 by pushing up the piston 22 from the outer peripheral face of the barrel portion

6*a* of the central shaft 6 not only when it rolls on the outer peripheral face of the barrel portion 6*a* of the central shaft 6 but also when it is engaged with the detent grooves 27*c* to 27*o*. As a result, the detent roller 26 can generate a check force against the door D due to the repulsive force of the check spring 23 by engaging with the fully closed detent groove 27*c*, the first intermediate detent groove 27*m*1, the second intermediate detent groove 27*m*2, and the fully open detent groove 27*o*.

Figure 8:
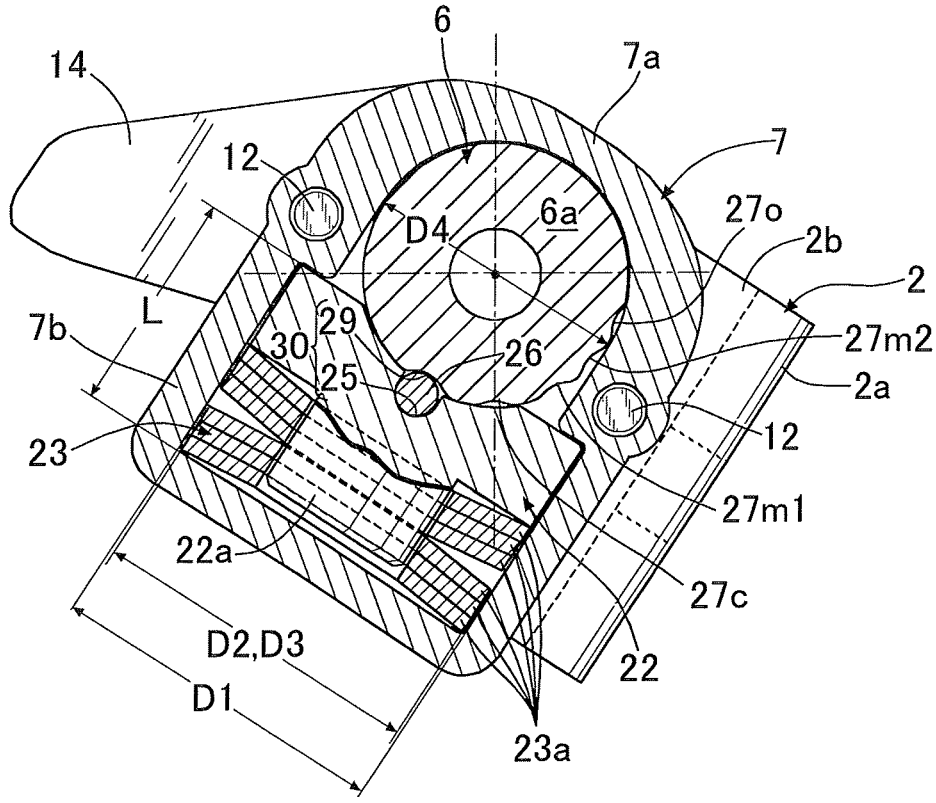
FIG. 8 is a diagram for explaining the procedure of mounting a detent roller of the checker-equipped door hinge device. (first embodiment)

As shown in FIG. 8, the outer peripheral face of the barrel portion 6*a* of the central shaft 6 is provided with an assembly groove 29 that enables the detent roller 26 to be inserted into the retaining groove 25 in a state in which the piston 22 abuts against the outer peripheral face of the barrel portion 6*a* of the central shaft 6 before the checker-equipped door hinge device H is assembled to the vehicle. That is, the assembly groove 29 is provided at a position, on the opposite side of the fully closed detent groove 27*c* to the first intermediate detent groove 27*m*1, on the outer peripheral face of the barrel portion 6*a* of the central shaft 6. This assembly groove 29 is formed so as to be deeper than the detent grooves 27*c* to 27*o* so that it forms an insertion hole 30 having a larger diameter than the detent roller 26 in cooperation with the retaining groove 25 when it opposes the retaining groove 25 even in a state in which the piston 22 abuts against the outer peripheral face of the barrel portion 6*a* of the central shaft 6. Therefore, such an insertion hole 30 enables the detent roller 26 to be inserted thereinto without interference from the check spring 23.

As shown in FIG. 2 and FIG. 4, opposite end parts, along the axial direction of the central shaft 6, of the cylinder block 7 are opened and become openings 10 and 10, and these openings 10 and 10 are closed by the pair of male arm portions 2*b* and 2*b* fixedly secured to opposite end faces of the cylinder block 7.

The central shaft 6, the cylinder block 7, the piston 22, and the check spring 23 thus form in cooperation with each other a check force generating mechanism 20 that generates a check force against the door D when the door D is at the predetermined fully closed position C, first intermediate degree of opening position M1, second intermediate degree of opening position M2, and fully open position O.

Figure 7:
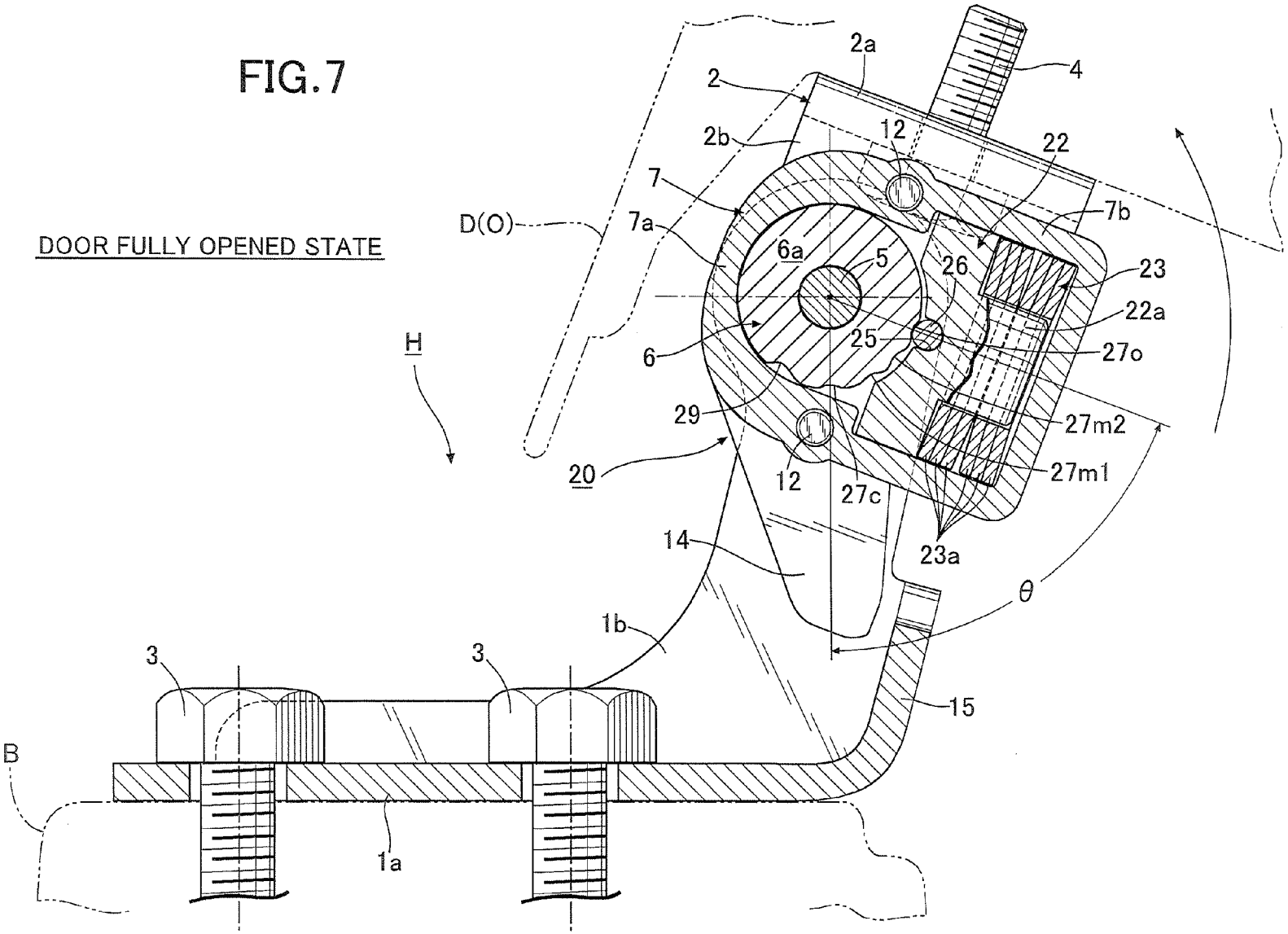
FIG. 7 is a view, corresponding to FIG. 6, showing the checker-equipped door hinge device in a state in which the door is fully open. (first embodiment)

As shown in FIG. 2 and FIG. 7, a stopper arm 14 is provided so as to be connected to parts, on one side, of the male arm portions 2*b* and 2*b*, and the fully open limit of the door D is restricted by the stopper arm 14 abutting against a stopper wall 15 that rises from the female base portion 1*a* of the female bracket 1 and integrally links the two female arm portions 1*b* and 1*b*.

The operation of this first embodiment is now explained.

Assembly of the checker-equipped door hinge device H is carried out before it is mounted on the vehicle; first, the central shaft 6, the piston 22, the check spring 23, and the detent roller 26 are housed in the cylinder block 7 from the openings 10 and 10 thereof, thus assembling the check force generating mechanism 20. In this process, putting the assembly groove 29 of the central shaft 6 opposite the retaining groove 25 of the piston 22 allows the assembly groove 29 and the retaining groove 25 to form the insertion hole 30, which has a larger diameter than that of the detent roller 26, and even in a state in which the piston 22 is pressed against the outer peripheral face of the central shaft 6 by means of the set load of the check spring 23, the detent roller 26 can easily be inserted into the insertion hole 30. After the insertion, the pair of male arm portions 2*b* and 2*b* of the male bracket 2 are fixedly secured by the screws 12 and 12 to opposite end faces of the cylinder block 7 on which the openings 10 and 10 open, thus air-tightly and water-tightly closing the openings 10 and 10 and preventing the detent roller 26 from falling out. In this process, the bearing bushes 16 and 16 supporting the short shafts 6*b* and 6*b* of the central shaft 6 are fitted into the bearing holes 11 and 11 of the male arm portions 2*b* and 2*b*.

In this way, since the check force generating mechanism 20 equipped with the male bracket 2 is first assembled as a unit independently of the female bracket 1 and the hinge pin 5, the assembly operation can be carried out efficiently and easily. Moreover, the pair of male arm portions 2*b* and 2*b* of the male bracket 2 are adjacent to the inside faces of the pair of female arm portions 1*b* and 1*b* and are disposed so as to sandwich the cylinder block 7 along the axial direction of the central shaft 6, and it is therefore possible to prevent the dimensions of the male bracket 2 from increasing and contribute to making the checker-equipped door hinge device H compact.

Furthermore, since the openings 10 and 10 of the cylinder block 7 from which the central shaft 6, the piston 22, the check spring 23, and the detent roller 26 are inserted are closed by the male arm portions 2*b* and 2*b* of the male bracket 2, the male bracket 2 also functions as a lid body for closing the openings 10 and 10, thus simplifying the structure.

Moreover, since the pair of male arm portions 2*b* and 2*b* connected to the male base portion 2*a* are linked integrally to each other via the cylinder block 7, it becomes unnecessary to employ a large-size male base portion that directly integrally links the two male arm portions 2*b* and 2*b*, and it is possible to make the male bracket 2 lightweight and compact.

Furthermore, due to the mutual effect of setting the length L in the axial direction of the cylinder portion 7*b* smaller than the inside measurement D1 or the internal diameter thereof and housing the plurality of disc springs 23*a* superimposed on one another as the check spring 23 within the cylinder portion 7*b*, it is possible to apply a sufficient check force to the door D while minimizing the amount of cylinder portion 7*b* projecting toward the central shaft 6, and make the check force generating mechanism 20 compact effectively. In this process, since the outside measurement D2 or the external diameter of the piston 22 and the external diameter D3 of the disc springs 23*a*, which are housed in the cylinder portion 7*b*, are set larger than the external diameter D4 of the central shaft 6, it is possible to suppress excessive increase in the spring constant while applying a sufficient set load to the plurality of disc springs 23*a*, which correspond to the check spring 23, thereby improving the durability thereof.

Moreover, forming the piston 22 and the cylinder portion 7*b* so as to have a rectangular cross section enables the cylinder portion 7*b* to prevent the piston 22 from rotating, enables engagement between the detent roller 26 and each of the detent grooves 27*c*, 27*m*1, 27*m*, and 27*o* always to be carried out appropriately, and makes it unnecessary to employ a special detent member for the piston 22, thus contributing to simplification of the structure.

After the check force generating mechanism 20 equipped with the male bracket 2 is assembled, the male bracket 2 is inserted into the female bracket 1 so that the male arm portions 2*b* and 2*b* are adjacent to the inside faces of the corresponding female arm portions 1*b* and 1*b*, the positioning projections 8 and 8 of the short shafts 6*b* and 6*b* of the central shaft 6 are fitted into the positioning grooves 9 and 9 of the female bracket 1, the hinge pin 5 is fitted from the female bracket 1 to the central shaft 6, and assembly of the checker-equipped door hinge device H is thus completed.

After the checker-equipped door hinge device H is assembled, pivoting the cylinder block 7 relative to the central shaft 6 allows the detent roller 26 to move toward the fully closed detent groove 27*c* side. In this process, the detent roller 26 pushes up the piston 22 and escapes from the assembly groove 29 while compressing the check spring 23; when arriving at the position of the fully closed detent groove 27*c* the detent roller 26 is engaged with the fully closed detent groove 27*c* due to the repulsive force of the compressed check spring 23 and, in order to continue to apply the compressive repulsive force of the check spring 23 to the detent roller 26 also in this engaged state, the depth of the fully closed detent groove 27*c* is set so that the piston 22 does not abut against the outer peripheral face of the barrel portion 6*a* of the central shaft 6. With regard to this state, the same applies to the engaged state between the detent roller 26 and the first and second intermediate detent grooves 27*m*1 and 27*m*2 and the fully open detent groove 27*o*. This means that in a state in which the checker-equipped door hinge device H is mounted on the vehicle, a sufficient checker force can be applied to the door D when the door D is at the predetermined fully closed position C, first and second intermediate degree of opening positions M1 and M2, and fully open position O.

When the checker-equipped door hinge device H is mounted on the vehicle, as shown in FIG. 7, in a state in which the female and male brackets 1 and 2 are opened from each other and the detent roller 26 is engaged with the fully open detent groove 27*o*, the female and male brackets 1 and 2 are fixedly secured to the body B and the door D respectively via the bolts 3 and 4.

When a user pivots the door D between the fully closed position C and the fully open position O, since the male bracket 2 joined to the door D similarly pivots, the cylinder block 7 linked to this male bracket 2 rotates relative to the central shaft 6 linked to the female bracket 1, the piston 22 and the check spring 23 supported on the cylinder block 7 also simultaneously rotate, and accompanying this the detent roller 26 retained by the retaining groove 25 of the piston 22 moves while rolling on the outer peripheral face of the central shaft 6.

In this process, when the door D comes to the predetermined fully closed position C, first and second intermediate degree of opening positions M1 and M2, or fully open position O, the detent roller 26 reaches the fully closed detent groove 27*c*, the first and second intermediate detent grooves 27*m*1 and 27*m*2, or the fully open detent groove 27*o*, which correspond to the above positions. As a result, the piston 22 retaining the detent roller 26 moves toward the central shaft 6 due to the compressive repulsive force of the check spring 23, and pushes the detent roller 26 strongly into each of the detent grooves 27*c* to 27*o*, thereby applying a sufficient check force to the door D as described above and preventing the door D from moving freely.

Applying to the door D a pivoting force that exceeds the above-mentioned check force allows the detent roller 26 to compressively deform the check spring 23 via the piston 22 and to escape from the detent grooves 27*c* to 27*o*, thus enabling the door D to pivot.

In this way, with regard to the checker-equipped door hinge device H, since the detent roller 26 moves throughout a range θ from the fully closed detent groove 27*c* to the fully open detent groove 27*o* accompanying opening and closing of the door D, the detent roller 26 does not reach the assembly groove 29, which is disposed outside the movement range θ, and it is thus possible to prevent the detent roller 26 from rattling.

Embodiment 2

Figure 9:
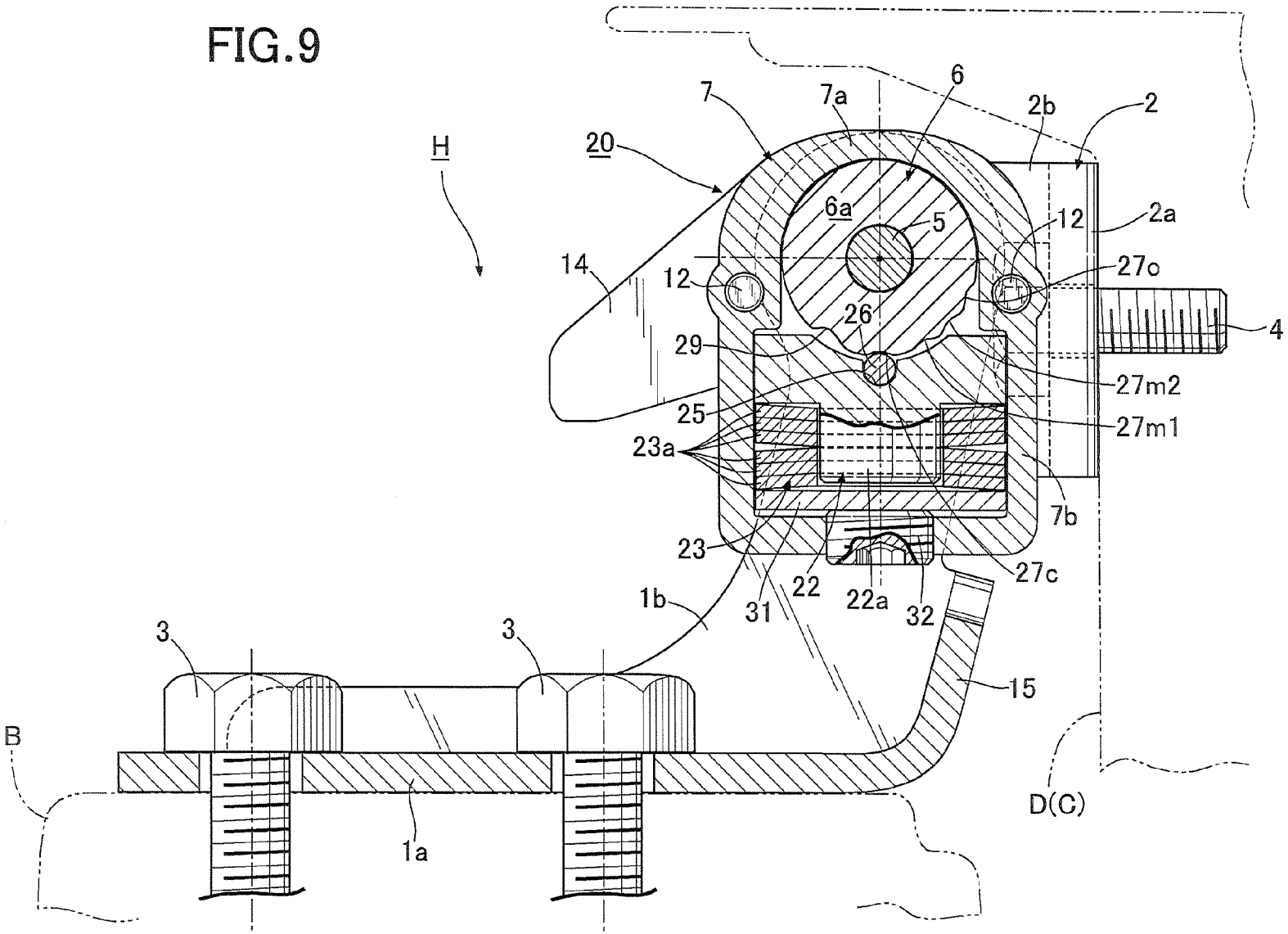
FIG. 9 is a view, corresponding to FIG. 6, showing a second embodiment of the present invention. (second embodiment)

A second embodiment of the present invention shown in FIG. 9 is now explained.

In this second embodiment, a support plate 31 is inserted between a bottom wall of a cylinder portion 7*b* and an outer end of a check spring 23, and an adjustment bolt 32 for enabling the support plate 31 to move forward and backward relative to the check spring 23 is screwed into the bottom wall of the cylinder portion 7*b*. Since the arrangement is otherwise the same as the preceding embodiment, in FIG. 9, portions corresponding to the preceding embodiment are denoted by the same reference numerals and symbols, and duplication of the explanation is therefore omitted.

In accordance with this second embodiment, moving the support plate 31 forward and backward relative to the check spring 23 by operation of the adjustment bolt 32 enables the set load of the check spring 23 to be adjusted and the check force for the door D to be simply set at a desired value. Furthermore, since, when assembling a check force generating mechanism 20, the load of the check spring 23 can be made zero or a minimum by retaining the support plate 31 at a retracted position, it is possible to easily carry out fitting of a piston 22, a central shaft 6, and a detent roller 26, thus improving the ease of assembly.

The present invention is not limited to the above-mentioned embodiment and may be modified in a variety of ways as long as the modifications do not depart from the spirit and scope thereof. For example, the female bracket 1 may be fixedly secured to the door D, and the male bracket 2 to the body B. Furthermore, the intermediate degree of opening position for the door D retained by the checker-equipped door hinge device may be either a single position or a plurality of positions. Moreover, the checker-equipped door hinge device H may be applied to a hinge device that supports a door for opening and closing a tailgate of a wagon type vehicle.

The invention claimed is:

1. A checker-equipped door hinge device for use in a vehicle, the device comprising a female bracket (1) that is formed from a female base portion (1*a*) adapted to be fixedly secured to one of a body (B) and a door (D) and a pair of female arm portions (1*b*) rising from opposite side ends of the female base portion (1*a*), a male bracket (2) that is disposed between the pair of female arm portions (1*b*) while having a male base portion (2*a*) adapted to be fixedly secured to the other of the body (B) and the door (D) and is relatively pivotably linked to the female arm portions (1*b*) via a hinge pin (5), and a check force generating mechanism that is arranged between the female and male brackets (1, 2) and generates a check force for the door at a predetermined degree of opening position of the door, this check force generating mechanism comprising a central shaft (6) that is fixed to the female bracket (1) and disposed around the hinge pin (5), a cylinder block (7) that is fixed to the male bracket (2) and disposed so as to relatively rotatably surround the central shaft (6) and has a cylinder portion (7*b*) projecting toward one side of the central shaft (6), a piston (22) that is slidably fitted into an inner peripheral face of the cylinder portion (7*b*), a detent roller (26) that is supported by the piston (22) and can roll on an outer peripheral face of the central shaft (6), a check spring (23) that urges the piston (22) toward the outer peripheral face of the central shaft (6), and at least one detent groove (27*c*, 27*m*1, 27*m*2, 27*o*) that is provided on the outer peripheral face of the central shaft (6) and with which the detent roller (26) is resiliently engaged by means of an urging force of the check spring (23) at the predetermined degree of opening position of the door (D), characterized in that the male bracket (2) comprises a pair of male arm portions (2*b*) that are adjacent to respective inside faces of the pair of female arm portions (1*b*) and are disposed so as to sandwich the cylinder block (7)

along an axial direction of the central shaft (6), and the male base portion (2*a*), which is provided so as to be connected to one end of these male arm portions (2*b*), each of the male arm portions (2*b*) is fixedly secured to the cylinder block (7), a bearing hole (11) supporting the central shaft (6) is provided in the pair of male arm portions (2*b*), and opposite end parts of the central shaft (6) extending through these bearing holes (11) are fixedly secured to the female arm portions respectively (1*b*).

2. The checker-equipped door hinge device for use in a vehicle according to claim 1, wherein the cylinder block (7) comprises a bearing portion (7*a*) that has a U-shaped cross section and relatively rotatably supports a semi-circumferential face of the central shaft (6), and the cylinder portion (7*b*), which is linked integrally to opposite end parts of the bearing portion (7*a*), an opening (10) is provided at opposite ends, along the axial direction of the central shaft (6), of the cylinder block (7), the opening (10) enabling the central shaft (6), the piston (22), the check spring (23), and the detent roller (26) to be housed in the cylinder block (7), and each opening (10) is closed by the respective male arm portion (2*b*).

3. The checker-equipped door hinge device for use in a vehicle according to claim 2, wherein a length (L) in an axial direction of the cylinder portion (7*b*) is set smaller than an inside measurement (D1) or internal diameter thereof, and a plurality of disc springs (23*a*) superimposed on one another as the check spring (23) are housed within the cylinder portion (7*b*).

4. The checker-equipped door hinge device for use in a vehicle according to claim 2, wherein the cylinder portion (7*b*) and the piston (22) are formed so as to have a rectangular cross section.

5. The checker-equipped door hinge device for use in a vehicle according to claim 1, wherein a length (L) in an axial direction of the cylinder portion (7*b*) is set smaller than an inside measurement (D1) or internal diameter thereof, and a plurality of disc springs (23*a*) superimposed on one another as the check spring (23) are housed within the cylinder portion (7*b*).

6. The checker-equipped door hinge device for use in a vehicle according to claim 5, wherein an outside measurement (D2) or external diameter of the piston (22) and an external diameter (D3) of the disc spring (23*a*) are set larger than an external diameter (D4) of the central shaft (6).

7. The checker-equipped door hinge device for use in a vehicle according to claim 6, wherein the cylinder portion (7*b*) and the piston (22) are formed so as to have a rectangular cross section.

8. The checker-equipped door hinge device for use in a vehicle according to claim 5, wherein the cylinder portion (7*b*) and the piston (22) are formed so as to have a rectangular cross section.

9. The checker-equipped door hinge device for use in a vehicle according to claim 1, wherein the cylinder portion (7*b*) and the piston (22) are formed so as to have a rectangular cross section.

10. The checker-equipped door hinge device for use in a vehicle according to claim 1, wherein a positioning projection (8) is formed on each of the opposing end faces of the central shaft (6), and a positioning groove (9) is formed on an inside face of each of the female arm portions, such that said positioning projections respectively engage said positioning grooves, each positioning projection (8) being provided so as to extend on an end face of the central shaft (6) along a diameter thereof, each positioning groove (9) being provided on an inside face of the female arm portion (1*b*) so that one end of the positioning groove (9) opens on an outer peripheral face of the female arm portion (1*b*), and a state in which the positioning projection (8) and the positioning groove (9) are engaged being retained by the hinge pin (5) extending through the female arm portions (1*b*) and the central shaft (6).

* * * * *